US006952938B2

(12) United States Patent
Albertson

(10) Patent No.: US 6,952,938 B2
(45) Date of Patent: Oct. 11, 2005

(54) PURGE SYSTEM AND METHOD OF USE

(75) Inventor: Luther D. Albertson, Sellersburg, IN (US)

(73) Assignee: Redi Controls, Inc., Greenwood, IN (US)

( * ) Notice: Subject to any disclaimer, the term of this patent is extended or adjusted under 35 U.S.C. 154(b) by 0 days.

(21) Appl. No.: 10/447,624

(22) Filed: May 29, 2003

(65) Prior Publication Data

US 2003/0221444 A1 Dec. 4, 2003

Related U.S. Application Data

(60) Provisional application No. 60/384,281, filed on May 30, 2002.

(51) Int. Cl.[7] ..... F25B 43/02

(52) U.S. Cl. ..... 62/472; 62/85; 62/149; 62/475

(58) Field of Search ..... 62/85, 149, 195, 62/468, 469, 470, 471, 472, 475

(56) References Cited

U.S. PATENT DOCUMENTS

| | | | | |
|---|---|---|---|---|
| 4,208,883 A | * | 6/1980 | Stirling | 62/192 |
| 4,589,826 A | | 5/1986 | Zimmern et al. | |
| 4,942,741 A | | 7/1990 | Hancock et al. | |
| 4,998,413 A | | 3/1991 | Sato et al. | |
| 5,001,908 A | | 3/1991 | Mayer | |
| 5,050,401 A | | 9/1991 | Van Steenburgh, Jr. | |
| 5,067,327 A | | 11/1991 | Leblanc | |
| 5,182,918 A | | 2/1993 | Manz et al. | |
| 5,187,940 A | | 2/1993 | Paxton | |
| 5,193,351 A | * | 3/1993 | Laukhuf et al. | 62/77 |
| 5,247,803 A | | 9/1993 | Adams et al. | |
| 5,261,246 A | | 11/1993 | Blackmon et al. | |
| 5,321,956 A | | 6/1994 | Kemp et al. | |
| 5,327,741 A | * | 7/1994 | Mason et al. | 62/149 |
| 5,363,662 A | | 11/1994 | Todack | |
| 5,377,501 A | | 1/1995 | Muston | |
| 5,465,590 A | | 11/1995 | Van Steenburgh, Jr. et al. | |
| 5,469,713 A | | 11/1995 | Wardle et al. | |
| 5,479,788 A | | 1/1996 | Roegner | |
| 5,535,596 A | | 7/1996 | Todack | |
| 5,544,492 A | | 8/1996 | Manz | |
| 5,544,494 A | | 8/1996 | Manz et al. | |
| 5,553,460 A | | 9/1996 | Isaacs | |

(Continued)

OTHER PUBLICATIONS

Tatara, Robert A., Ph.D., and Payvar, Parviz, Ph.D., P.E., "Effects of Oil on Boiling of Replacement Refrigerants Flowing Normal to a Tube Bundle–Part 1: R–123" *ASHRE Transactions 2000*, V. 106, Pt. 1, American Society of Heating, Refrigerating and Air Conditioning Engineers, Inc.

"Conserve refrigerant, preserve the environment," Trane Intercleam™ In–Line Refrigerant Clean–Up System Model ICCA Engineering Bulletin, X39640384–01.

Tatara, Robert A., Ph.D., and Payvar, Parviz, Ph.D., P.E., "Effects of Oil on Boiling of Replacement Refrigerants Flowing Normal to a Tube Bundle–Part I1: R–134a" *ASHRE Transactions 2000*, V. 106, Pt. 1, American Society of Heating, Refrigerating and Air–Conditioning Engineers, Inc.

*Primary Examiner*—Melvin Jones
(74) *Attorney, Agent, or Firm*—Krieg DeVault LLP

(57) ABSTRACT

A purge system operable to remove lubricant from a liquid refrigerant material removed from an evaporator of a mechanical refrigeration system. The contaminated liquid refrigerant is delivered to the purge system by gravity and the separated lubricant is returned to the compressor sump by force from a pressurized fluid. Refrigerant vapor is separated from the contaminated liquid refrigerant by heating and returned to the evaporator of the mechanical refrigeration system.

35 Claims, 4 Drawing Sheets

U.S. PATENT DOCUMENTS 5,570,590 A 11/1996 Hansen et al.
5,582,019 A * 12/1996 Hanna et al. ..... 62/85
5,603,223 A 2/1997 Murray et al.
5,617,731 A 4/1997 Scaringe
5,623,833 A 4/1997 Mitchell et al.
5,638,689 A 6/1997 Scaringe et al.
5,647,961 A 7/1997 Lofland
5,685,161 A 11/1997 Peckjian et al.
5,704,215 A 1/1998 Lord et al.
5,709,091 A 1/1998 Todack
5,735,139 A 4/1998 Lord et al.
5,802,859 A 9/1998 Zugibe
5,910,160 A 6/1999 Cakmakci et al.
5,943,867 A 8/1999 Thomas et al.
6,138,462 A 10/2000 Murray et al.
6,141,977 A 11/2000 Zugibe
6,237,362 B1 5/2001 Jang
6,244,059 B1 6/2001 Hill
6,263,691 B1 7/2001 Ueno et al.

* cited by examiner

PURGE SYSTEM AND METHOD OF USE

CROSS-REFERENCE TO RELATED APPLICATIONS

The present application claims the benefit of U.S. Provisional Patent Application No. 60/384,281 filed May 30, 2002, which is incorporated herein by reference.

BACKGROUND OF THE INVENTION

The present invention relates generally to the field of purge systems utilized in the servicing of mechanical refrigeration systems. More particularly, in one form the present invention is directed to a method and apparatus for removing a lubricant from a contaminated refrigerant material discharged from an evaporator of a mechanical refrigeration system.

Mechanical refrigeration systems generally function in a continuous fashion and reuse the refrigerant material circulating in the refrigeration system. Typically, three pieces of equipment including an evaporator, a condenser and a compressor are utilized in the refrigeration system. In the evaporator, cold liquid refrigerant is warmed by absorbing heat from the medium to be cooled. As the liquid refrigerant temperature rises, the liquid refrigerant is evaporated and forms a warm refrigerant vapor. The warm refrigerant vapor is then delivered to the compressor. The compressor compresses the refrigerant vapor to raise the pressure of the vapor and thereby lower the temperature at which the refrigerant vapor will condense. This resulting hot refrigerant vapor is then piped to the condenser to be cooled and change phase to the liquid state. The liquid refrigerant is then transported to the evaporator where the refrigeration cycle begins over again.

Mechanical refrigeration system designers will appreciate that there are many different styles, types and designs for compressors. It is well recognized that all compressors in one way or another mechanically compress the refrigerant vapor to cause a pressure rise in the gas. The mechanical action needed to increase the pressure requires moving parts and the moving parts require the use of lubricants to reduce friction between the associated mechanical components. The inevitable wear on the compressor components and the practical limitations on mechanical seals allows for the intermixing of the lubricant and refrigerant material within the mechanical refrigeration system. Over time, the refrigerant material becomes contaminated with lubricant material and other various substances such as acids. Contamination of the refrigerant material with lubricant reduces the refrigerant materials ability to perform the refrigeration cycle efficiently. Additionally, the loss of lubricant from the compressor requires that lubricant must be periodically added to the compressor to account for the loss of lubricant.

A purge system for removing substantially all of the lubricant from the contaminated liquid refrigerant material of the refrigerant system has significant advantages. The removal of the lubricant from the refrigerant material results in marked increase in the heat transfer from the medium to be cooled and an enhanced efficiency of the system. The reclaimed refrigerant material with the lubricant removed therefrom can be pumped back into the mechanical refrigeration system for continued reuse in the refrigeration cycle. The lubricant that has been separated from the contaminated refrigerant material can be reclaimed and/or returned to the compressor for lubricating the mechanical components therein.

There remains a need for a purge unit and method of operation for removing a lubricant from the contaminated refrigerant material utilized in a mechanical refrigeration system. The present invention satisfies this need in a novel and non-obvious way.

SUMMARY OF THE INVENTION

One form of the present invention contemplates a purge system for processing a contaminated liquid refrigerant to remove a lubricant material therefrom and return the lubricant to the lubricant sump of a compressor in a mechanical refrigeration system.

Another form of the present invention contemplates a purge system adapted to automatically separate from the refrigerant charge of a refrigeration system, the lubricant and refrigerant, and return the lubricant and refrigerant to the respective portions of the refrigeration system.

Another form of the present invention contemplates a method for substantially removing a lubricant material from a contaminated liquid refrigerant within a mechanical refrigeration system. The method, comprising: flowing a quantity of the contaminated liquid refrigerant from the mechanical refrigeration system into a mechanical housing; heating the contaminated liquid refrigerant within the mechanical housing to a temperature that enables the substantial separation into components comprising refrigerant material vapor and liquid lubricant; flowing the refrigerant material vapor from the mechanical housing into the mechanical refrigerant system; discharging the liquid lubricant from the mechanical housing; and delivering the liquid lubricant from the mechanical housing to a compressor sump within the mechanical refrigeration system.

Yet another form of the present invention contemplates a system comprising: a mechanical refrigeration system including a compressor having a lubricant sump, a condenser and an evaporator including a vessel, the refrigeration system containing an amount of contaminated liquid refrigerant including at least refrigerant material and lubricant material, a purge unit disposed in fluid communication with the mechanical refrigeration system, the purge unit comprising: a mechanical housing having a first end and an opposite second end and an interior volume adapted to receive a quantity of the contaminated liquid refrigerant, the mechanical housing having a contaminated liquid refrigerant material inlet proximate the first end, a lubricant outlet proximate the first end and a gaseous material outlet proximate the second end; a heater disposed in heat transfer relationship with the mechanical housing and operatively controlled to provide heat to the interior volume to vaporize the refrigerant material within the contaminated liquid refrigerant into a refrigerant vapor and substantially separate the refrigerant material from the lubricant; wherein the contaminated liquid material inlet is coupled in fluid communication with the vessel, wherein the lubricant outlet is coupled in fluid communication with the lubricant sump, and further wherein the gaseous material outlet is coupled in fluid communication with the vessel; and, the flow of contaminated liquid material from the vessel to the liquid material inlet is by gravitational forces, and the heater is operable to vaporize the refrigerant material to the refrigerant vapor and create a pressure differential between the interior volume and the lubricant sump and the vessel, and wherein the pressure differential is utilized to selectively push the lubricant through the lubricant outlet and to the lubricant sump and further selectively push the refrigerant vapor through the gaseous material outlet and to the vessel.

Yet another form of the present invention contemplates a method for substantially removing a lubricant material from a contaminated liquid refrigerant within a mechanical refrigeration system. The method comprising: flowing a quantity of the contaminated liquid refrigerant by gravitational force from an evaporator within the mechanical refrigeration system into a mechanical housing of a purge unit; heating the contaminated liquid refrigerant within the mechanical housing to a first predetermined temperature appropriate for the substantial separation into components comprising refrigerant material vapor and liquid lubricant; sensing the temperature within the mechanical housing to determine whether the first predetermined temperature has been satisfied; maintaining the contaminated liquid refrigerant within a first predetermined temperature range for a first predetermined time and substantially separating the quantity of contaminated liquid refrigerant into refrigerant material vapor and liquid lubricant; flowing the refrigerant material vapor from the mechanical housing into the evaporator at a location above the liquid level of the evaporator; pushing the liquid lubricant from the mechanical housing with a pressure differential between the mechanical housing and the mechanical refrigeration system; and repeating the above acts for all of the contaminated liquid refrigerant within the mechanical refrigeration system.

One object of the present invention is to provide a unique system for removing lubricant from a contaminated liquid refrigerant material.

Related objects and advantages of the present invention will be apparent from the following description.

DESCRIPTION OF THE PREFERRED EMBODIMENTS

Figure 1:
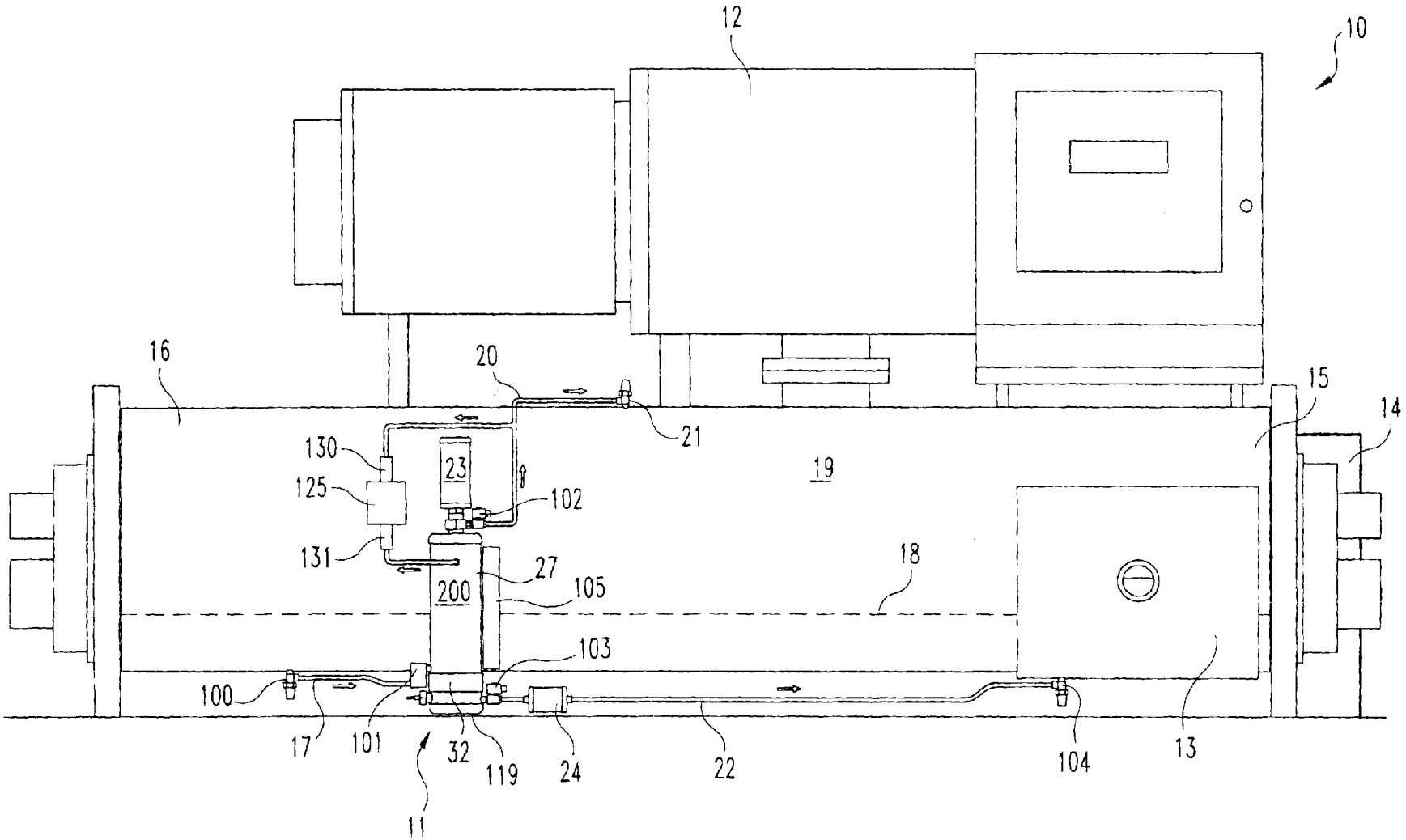
FIG. 1 is a schematic illustration of a mechanical refrigeration system coupled in fluid communication with one form of the purge unit of the present application.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is illustrated a mechanical refrigeration system 10 disposed in fluid communication with one embodiment of the purge system 11 of the present invention. The mechanical refrigeration system 10 comprises a closed loop system having three primary components. The three components are a compressor 12 with a lubricant sump 13, a condenser 14 and an evaporator 15. The mechanical refrigeration system 10 set forth in FIG. 1 is of the flooded evaporator type in which the liquid refrigerant material lays in the vessel 16 comprising a portion of the evaporator 15. A liquid refrigerant level line 18 is provided to aid the reader in understanding the location of and fluid levels within the vessel 16. The liquid level is indicated at 18 and the gaseous level 19 is located atop the liquid level 18. The compressor 12 functions to pressurize the gaseous refrigerant material located within the evaporator 15.

The relatively high-pressure refrigerant gas upon exiting the compressor flows into the condenser 14, which functions as a heat exchanger. The condenser 14 removes energy from the vaporized refrigerant to facilitate the condensation of the relatively high-pressure refrigeration vapor into the liquefied refrigerant. The cooled liquid refrigerant then flows through an expansion device that reduces the fluid pressure and regulates the flow of refrigerant fluid into the evaporator 15. Evaporator 15 functions to cool a heat exchange medium passing through heat exchanger tubes located within the vessel 16. The liquid refrigerant within the evaporator 15 is vaporized into a relatively low-pressure refrigerant gas by the heat radiating from heat exchange medium passing through the heat exchanger tubes. The relatively low-pressure refrigerant gas is then drawn into the compressor 12 to begin the refrigeration cycle once again. Mechanical refrigeration systems are well known to one of ordinary skill in the art and therefore significant detail will not be provided for the refrigeration system herein. While the present description has set forth a mechanical refrigeration system including a flooded evaporator, it is contemplated that the present invention is applicable to use with a wide variety of other types of refrigeration systems.

The present invention is applicable with high and low pressure refrigerants. In one form the refrigeration system is capable of holding a refrigerant charge of about 300 pounds to about 2000 pounds. However, the present invention is applicable to use with refrigeration systems capable of holding differing refrigeration charge levels. Refrigerant materials are well known to one of ordinary skill in the art and will include herein all manmade refrigerants, such as, but not limited to R-11, R-123, R-113, R-114, R-12, R-134*a*, R-22.

Figure 2:
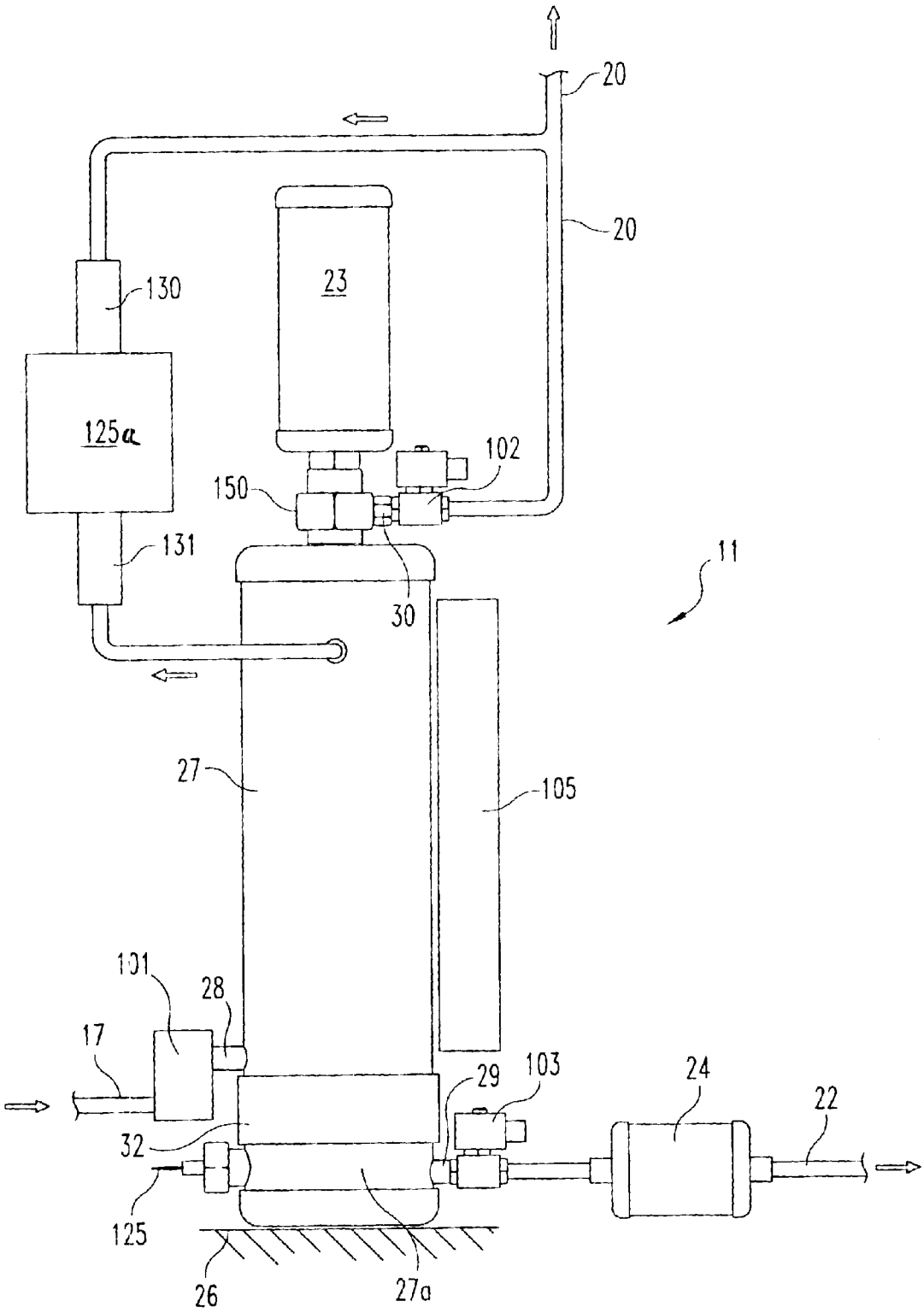
FIG. 2 is an enlarged view of the purge unit of FIG. 1.

With reference to FIGS. 1 and 2, there is illustrated the purge system 11 connected to the refrigeration system 10. Liquid refrigerant is discharged from the vessel 16 through a line 17 that is disposed in fluid communication with the purge system 11. In one form of the present invention the liquid refrigerant flows by gravitational forces from the vessel 16 into the purge system 11. The liquid refrigerant coming from the vessel 16 will be designated in this document, unless provided to the contrary, as contaminated liquid refrigerant material. In addition to the refrigerant, the contaminated liquid refrigerant material may include lubricant material, acids and moisture. However, it should be understood that the contaminated liquid refrigerant material may or may not in fact contain any substantial contaminants. Purge system 11 is operable to heat and thereby boil off the refrigerant material from the contaminated liquid refrigerant material. The refrigerant material is vaporized and returned to the evaporator 15 through a line 20 that is disposed in fluid communication with a vessel entry port 21. Vessel entry port 21 is located above the liquid refrigerant level 18 within the vessel 16. Lubricant material separated from the contaminated liquid refrigerant material is passed through a line 22 to the compressor sump 13. It should be understood herein that the lubricant material returned to the sump 13 may be substantially pure or may contain some quantity of contaminants such as refrigerant, moisture, acids, etc. In one form of the purge system 11 there is included a refrigerant vapor filter 23 and a lubricant filter 24. However, alternate embodiments of the present invention may have one of the filters, both of the filters or neither of the filters.

With reference to FIG. 2, there is an enlarged illustrative view of one form of the purge system 11. Purge system 11 is disposed in fluid communication with the evaporator 15 and is adapted to receive the contaminated liquid refrigerant material through line 17. The present invention contemplates that the purge system 11 can be permanently mounted and connected to the mechanical refrigeration system 10, or can be a portable system that is readily connected to the mechanical refrigeration systems. However, it is preferred that the purge system 11 is permanently mounted to the mechanical refrigeration system 10. Further, the purge system 11 can be installed on a new mechanical refrigeration system or installed in machines that have already been put in service. In one embodiment the purge system 11 sits directly on the floor 26, however it is contemplated that the system can sit on legs (not illustrated) that support the purge system 11 off of the floor 26.

The purge system 11 includes a primary mechanical housing/distillation housing 27 having a contaminated liquid refrigerant material inlet 28, a separated lubricant outlet 29 and a gaseous material outlet 30. Primary mechanical housing 27 includes an interior volume adapted to receive the contaminated liquid refrigerant material from the mechanical refrigeration system 11. A heater 32 is disposed in a heat transfer relationship with the primary mechanical housing 27 and is operatively controlled to provide heat to the contaminated liquid refrigerant material contained within the interior volume. In one form of the present invention the heater 32 is disposed along the outer surface of the housing 27. In a more preferred form, the heater is a 350 watt flexible band heater. The heat applied to the contaminated liquid refrigerant material causes the refrigerant material to vaporize and separate from the contaminated liquid refrigerant material within the housing 27. The lubricant material which comprised a portion of the contaminated liquid refrigerant material, is therefore separated from the contaminated liquid refrigerant material and discharged through the separated lubricant outlet 29.

In one form of the present invention the purge system 11 includes a refrigerant vapor filter 23 for filtering the refrigerant vapor prior to introduction into the evaporator 15. The filter/drying system aids in the removal of moisture and acids from the refrigerant vapor. The refrigerant vapor passes from the mechanical housing 27 through the filter 23 and then out through the gaseous material outlet 30 into the vapor return line to the evaporator 15. In a preferred form of the present invention the filter comprises an activated filter/dryer. Further, in one embodiment of the purge system, a lubricant filter 24 is disposed in fluid communication with the lubricant being returned to the compressor sump 13 and functions to filter the lubricant. In a preferred form, the filter 24 comprises an activated filter/dryer. The present invention contemplates alternate embodiments wherein the purge system includes only one of the filters or none of the filters.

The purge system 11 is typically placed on the floor 26 near the liquid refrigerant charging valve 100. The purge system 11 is located such that the refrigerant liquid level within the primary mechanical housing 27 rises to about one-half to two-thirds of the housing. In a more preferred form the liquid level within the housing rises to about the middle of the housing. However, the present invention is not limited to filling the housing 27 to the mid-level, as other fill heights are contemplated herein. In a preferred form, the purge system 11 is located relative to the evaporator liquid refrigerant material fill line 18 so that the refrigerant liquid level 200 within the purge system 11 will be no higher than about eighteen inches after gravity allows the refrigerant height to reach equilibrium between the evaporator and the unit. The installer will accomplish the preferred installation elevation by observing the liquid level in the evaporator 15 and properly positioning the base 11 of the purge system 11 on the floor or at the needed elevation to obtain the desired fill level.

Figure 2A:
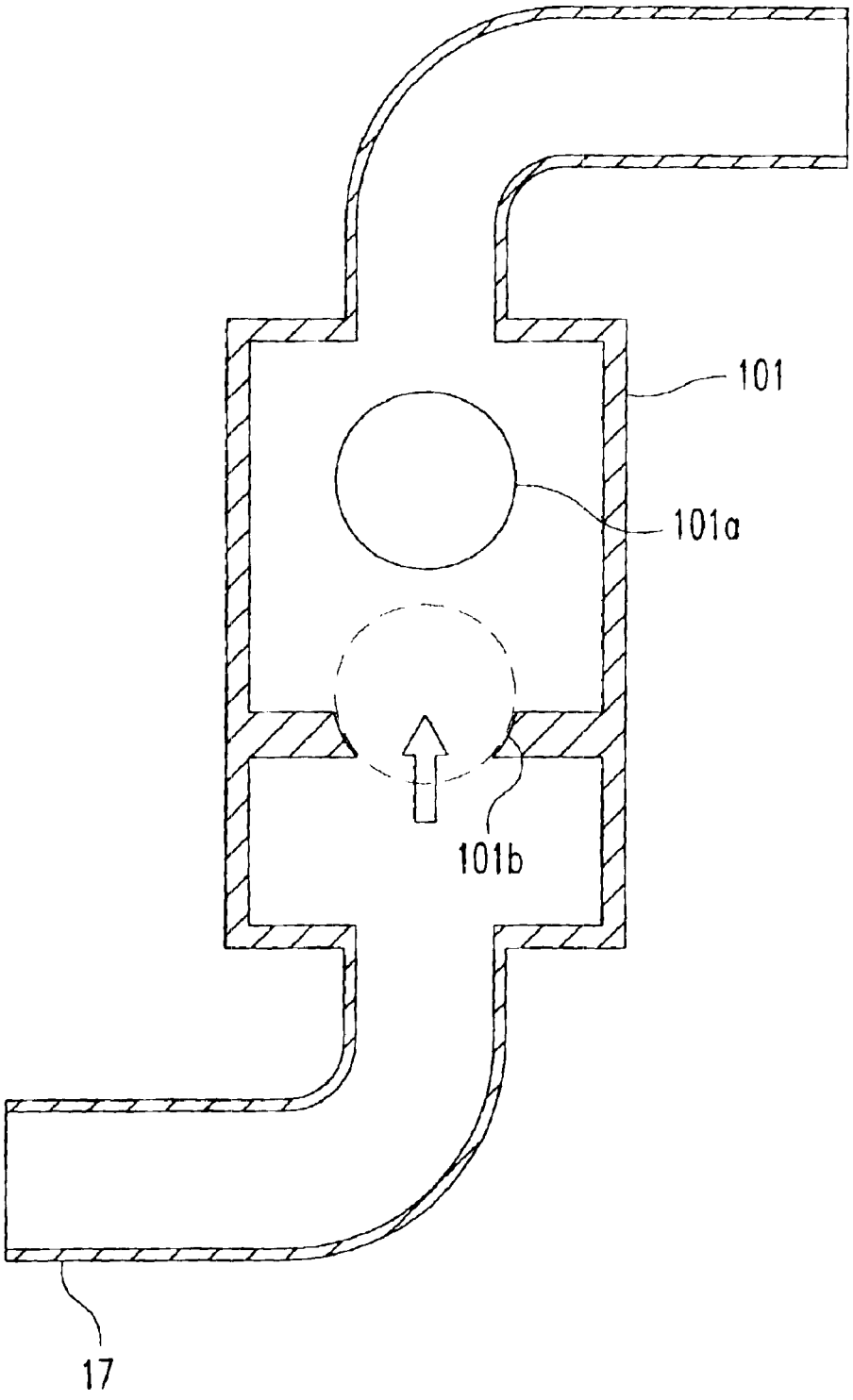
FIG. 2A is an illustrative view of one embodiment of a flow control device comprising a portion of the present application.

The liquid refrigerant fill line 17 is in fluid communication between liquid refrigerant charging valve 100 and a fluid flow control device 101. In one form the flow control device 101 is a liquid refrigerant solenoid valve and in a preferred form the flow control device 101 is a check valve. Referring to FIG. 2A, there is illustrated schematically the fluid flow through the check valve 101. The check valve 101 includes a ball 101*a* that is displaced from seal 101*b* to allow the passage of the contaminated liquid refrigerant material to flow into the mechanical housing 27. Upon the pressure within the housing 27 reaching a pressure greater than that the ball 101*b* is subjected to from the evaporator the ball 101*a* seals against the seat 101*b*. Ball 101*a* is shown in phantom to illustrate the sealing of the fluid flow.

In one form, the liquid refrigerant charging line 17 is connected to the liquid refrigerant charging valve at the lowest level for a valve within the system. Refrigerant vapor return line 20 is coupled between refrigerant vapor return solenoid valve 102 and the vessel port 21. Lubricant return line 22 is disposed in fluid communication with the lubricant return solenoid valve 103 and the lubricant sump charging valve 104. In one embodiment, a return lubricant filter 24 filters the lubricant flowing in the line 22. In another form of the present invention, a covered lubricant return line is connected to an auxiliary container for holding the lubricant recycled from the refrigerant. This alternative form of the present invention utilizing an auxiliary container is contemplated for initial cleaning applications of the contaminated lubricant within the refrigeration system. Upon substantial completion of the initial cleaning cycle of the contaminated lubricant within the mechanical refrigeration system, the lubricant return line is reconnected to the sump 13. However, the present application does not require the use of an auxiliary container and it is preferred that the present invention separates and returns the lubricant from the contaminated liquid refrigerant material directly to the sump.

The operation of the purge system 11 is controlled by logic module 105. In a preferred form of the present invention the logic module 105 is defined by a solid state circuit board (see FIG. 3). However, the present invention contemplates other control circuits including, but not limited to, electromechanical or micro processors. Further, there is no intention to limit the circuit board to the specific embodiment set forth in FIG. 3, unless specifically stated. Heater relay 110 is operable to control heater 32 through the temperature sensor 125. The temperature sensor 125 is preferably a liquid filled sensing bulb-type mechanical thermostat, and is located within a quantity of lubricant disposed in the bottom end portion 27*a* of the mechanical housing 27. However, other temperature sensors are contemplated herein. A quantity of lubricant is preferably situated below the lubricant discharge 29 in the bottom end portion 27*a* and therefore is not discharged from the housing. In a preferred form the quantity of lubricant in the bottom end portion 27*a* is about three pounds.

The utilization of a check valve 101 for the fluid flow control device allows for the passage of the contaminated liquid refrigerant material into the purge system 11. When the pressure acting on ball 101*a* overcomes the force acting on the ball 101*a* from the contaminated liquid refrigerant, the ball 101*a* will seat and stop the flow of contaminated liquid refrigerant into the primary mechanical housing 27. In another form of the present invention the passage of contaminated liquid refrigerant into the primary mechanical housing 27 is controlled by a solenoid valve 101. A refrigerant lubricant mixture fill relay 111 controls the refrigerant lubricant mixture solenoid valve 101. When the fluid flow control device 101 and the refrigerant vapor return solenoid valve 102 are open, the contaminated liquid refrigerant material will flow by gravity into the mechanical housing 27.

Lubricant transfer relay 113 controls the lubricant transfer solenoid valve 103, which controls the flow of lubricant to sump 13. In a preferred form the lubricant discharge is driven by the pressure differential. The purge fault alarm relay 114 upon activation, enunciates a purge fault indicator. This relay is activated by various conditions as programmed into the solid state logic board, and is designed to protect the mechanical refrigeration system 10 and the purge system 11. The refrigerant filter change alert relay 115 keeps track of the hours of usage of the refrigerant filter 23 and provides an alert upon passage of the threshold. In one form of the present invention, the refrigerant filter 23 has a life of 2000 hours of usage. A series of displays 116 through 121 are set forth as part of the logic module 105. One form of the displays are set forth in Table I.

TABLE I

| LED DISPLAY INDICATORS | | | |
|---|---|---|---|
| D1 | Green | Flashing | Indicates distillation tank is filling with refrigerant-lubricant mixture. |
| D2 | Green | Flashing | Indicates the primary distillation of refrigerant-lubricant mixture. |
| D3 | Green | Flashing | Indicates the secondary distillation of refrigerant-lubricant mixture. |
| D4 | Green | Flashing | Indicates lubricant transfer back to chiller's oil sump. |
| D5 | Green | On Solid | Indicates heater is on. |
| D6 | Red | Flashing | Indicates a fault condition. (See fault condition indication below). |

| FAULT CONDITION INDICATIONS: | | |
|---|---|---|
| D6 | Red Flashing & Green D1 On Solid | Temperature not below 145° F. within 14 minutes of fill phase start time. |
| D6 | Red Flashing & Green D2 On Solid | 145° F. not reached within 4 hours of start of the primary distillation phase. |
| D6 | Red Flashing & Green D3 On Solid | No activations of the equilization solenoid (112) occurred during distillation phases. |
| D6 | Red Flashing & Green D4 On Solid | At least 4 activations of equilization solenoid (112) did not occur during distillation phases. |

The pressure within the mechanical housing 27 is regulated by a differential pressure switch 125*a* that is exposed to the high pressure side 131 of the housing and the low pressure side 130 of the evaporator. The differential pressure switch 125*a* is operable to maintain an elevated pressure within the mechanical housing 27 relative to the pressure within the evaporator 15. In one form of the present invention, the pressure differential is maintained between about 4 psi and about 8 psi, and in a preferred form is maintained between about 6–9 psi. In operation, the differential pressure switch 125*a* functions to cause the refrigerant vapor solenoid valve 102 to open and relieve the pressure within the mechanical housing 27 when the internal pressure is higher than a predetermined upper pressure differential threshold, and to maintain the valve 102 in an open position until a predetermined lower pressure differential threshold is reached. In one form of the present invention, the valve 102 will be opened upon pressure differential between the interior of the mechanical housing 27 and the pressure within the evaporator being about 8 psi, and in a preferred form greater than about 9 psi. When the pressure differential drops to about 4 psi, the valve 102 will be closed, and in a preferred form when the pressure differential drops to about 6 psi the valve 102 will be closed. The present invention fully contemplates the utilization of other pressure differentials.

Filter 23 is disposed in fluid communication with the interior volume of the mechanical housing 27. In one form of the present invention, the filter 23 is removably coupled to the mechanical housing 27 by a quick-change coupler 150. The filter 23 and quick-change coupler 150 are operable so that when the filter 23 is screwed into the mechanical housing 27 it depresses a spring loaded o-ring sealed valve inside the mechanical housing 27. The depressing of the spring loaded o-ring sealed valve allows the refrigerant gas to flow around the valve and through the filter. When the filter 23 is removed from the mechanical housing 27, the spring-loaded o-ring sealed valve inside the distillation tank moves into place and blocks the escape of refrigerant. While one form of the purge system has been described with a quick-change coupler, other embodiments of the present invention contemplate a filter attached by other means.

Figure 3:
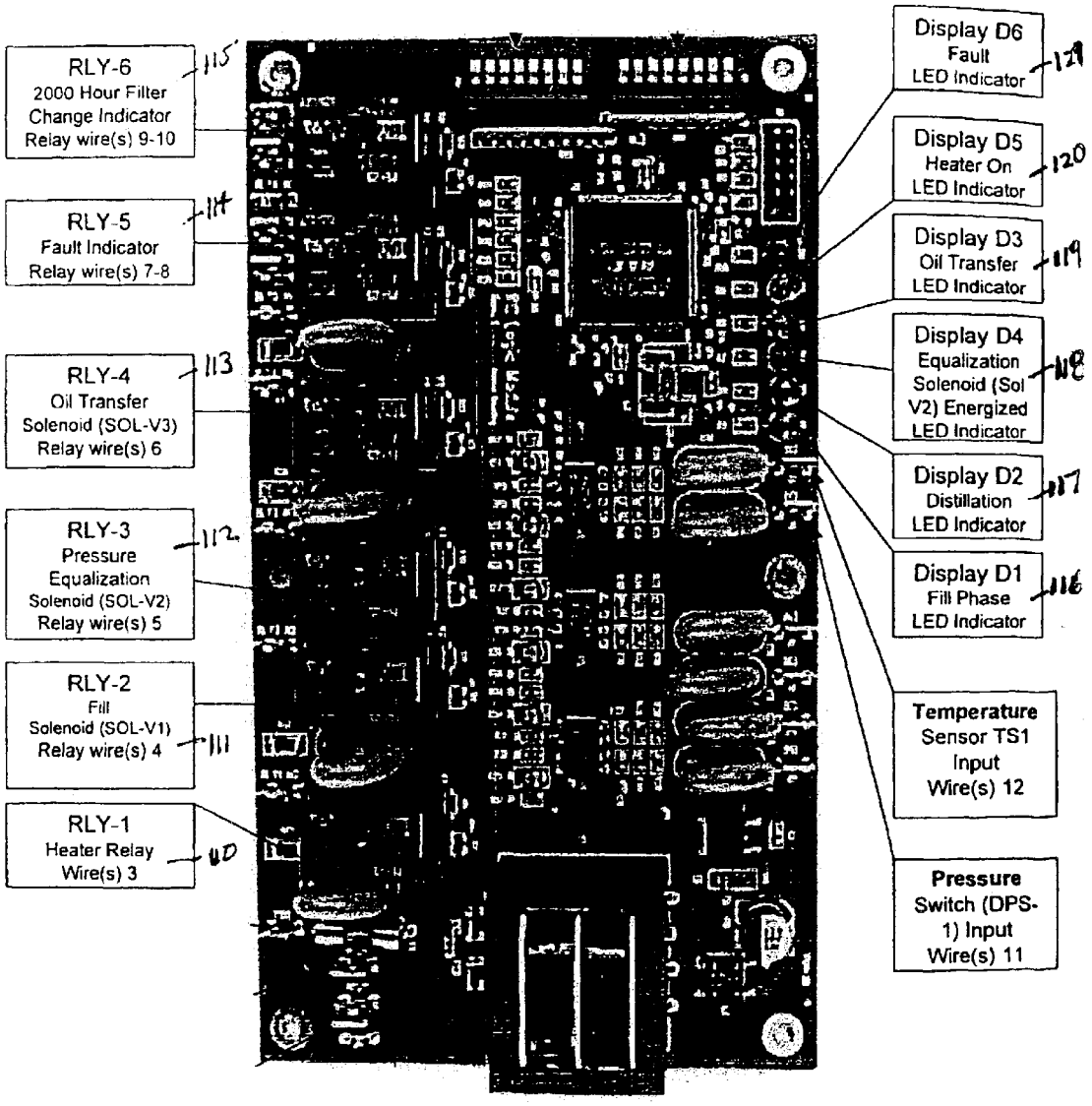
FIG. 3 is illustrative view of one embodiment of a circuit board of the present application.

The purge system 11 has been described with reference to the illustrations in FIGS. 1–3, and now the operation of the purge system 11 will be further set forth. However, before addressing the operation of the purge system 11, the reader needs to understand that in many mechanical refrigeration systems that have been used for an extended period of time, there has been a substantial amount of lubricant mixed into the refrigerant charge. Therefore, upon the initial use of purge system 11, a relatively large quantity of lubricant will be removed from the contaminated liquid refrigerant charge. Thereafter, the continued utilization of the purge system 11 maintains the refrigerant charge substantially free of lubricant. The preferred form of the purge system 11 is operable to remove lubricant, acid and moisture from the refrigerant charge. However, it is contemplated herein that purge systems of the present invention can be utilized to remove all or subsets of these materials.

The purge system 11 functions to clean the refrigerant charge by repeatedly removing from the evaporator, relatively small quantities of refrigerant contaminated with lubricant, and distilling off the refrigerant into a vapor and passing the vapor through a filter and back into the evaporator. Lubricant remaining after the distillation process within the mechanical housing 27 is then returned to the compressor sump. In one form of the present invention, the purge system 11 repeatedly removes batches of contaminated liquid refrigerant material having a weight of about 12 to 15 pounds from the refrigerant charge. In further describing the operation of the purge system 11, the batch of refrigerant removed for processing from the large refrigerant charge will weigh about 12 to 15 pounds. Further, in describing the operation of purge system 11, the operating cycle will be about 3½ to 4 hours. However, it should be understood that the present invention is not limited to the processing of batches of contaminated liquid refrigerant material having a weight of about 12 to 15 pounds and having an operating cycle of 3½ to 4 hours. The present invention contemplates other operating cycle times and that the batches being processed can have weights different than the above range.

The processing of the contaminated refrigerant is divided into the following phases: Fill phase (Phase I); Primary Distillation phase (Phase II); Secondary Distillation phase (Phase III); and Lubricant Transfer phase (Phase IV). In the Fill phase (Phase I), the contaminated refrigerant flows by gravity from the evaporator into the mechanical housing within a predetermined time period. In order to accomplish the Fill phase (Phase I), the Flow Control device 101 and valve 102 are open and valve 103 is closed. On completion of the Fill phase (Phase I), the valves 101 and 102 are closed. In one form of the present invention, the predetermined time for the Fill Phase (Phase I) is about thirty minutes and in a preferred form the predetermined time is about seventy-five minutes. At the end of the predetermined fill time, the Primary Distillation phase (Phase II) begins and the heater 32 is activated and heats the contaminated liquid refrigerant material within the mechanical housing 27. The addition of heat to the contaminated liquid refrigerant material functions to vaporize the refrigerant, moisture, and acid. These vapors flow through the filter 23 and the refrigerant gas ultimately flows back into the evaporator 15. The Primary Distillation phase (Phase II) of the contaminated liquid refrigerant material continues until the temperature sensor 125 senses that the temperature within the bottom region 27*a* of the mechanical housing 27 around the sensor, reaches a predetermined temperature. In a preferred form of the present invention, the predetermined temperature is about 145° F.

Upon completion of the Primary Distillation phase (Phase II), the remaining material located within the mechanical housing 27 is further distilled for a predetermined time during a Secondary Distillation phase (Phase III) at a controlled temperature. In one form of the present invention, the predetermined time for the Secondary Distillation phase (Phase III) is about 2½ hours and the predetermined temperature is about 145° F. and in a preferred form the predetermined time for the Secondary Distillation phase is about forty-five minutes and the predetermined temperature is about 145° F. At the end of the predetermined time for the Secondary Distillation phase (Phase III), the Lubricant Transfer phase (Phase IV) is initiated and the recovered lubricant, that is left after the refrigerant and other materials has been distilled, is transferred back to the compressor sump during a predetermined period of time. In a preferred form of the present invention, the predetermined period of time for Lubricant Transfer phase (Phase IV) is about six minutes. During the Lubricant Transfer phase, the refrigerant vapor return solenoid valve 102 and the flow control device 101 are closed and the lubricant return valve 103 is opened and the pressure of the refrigerant vapor within the mechanical housing 27 is utilized to push the lubricant into the sump 13. In one form, the pressure within the housing 27 is at least 4 psi greater than the pressure when the sump 13, and in a preferred form is within a range of about 6 to about 9 psi (pounds per square inch) greater than the pressure within the sump. However, the present invention contemplates the application of other temperatures and pressures during the phases of operation for the purge system.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed:

1. A method for substantially removing a lubricant material from a contaminated liquid refrigerant within a mechanical refrigeration system, comprising:

(a) flowing a quantity of the contaminated liquid refrigerant from the mechanical refrigeration system into a mechanical housing;

(b) heating the contaminated liquid refrigerant within the mechanical housing to a temperature that enables the substantial separation into components comprising refrigerant material vapor and liquid lubricant;

(c) flowing the refrigerant material vapor from the mechanical housing into the mechanical refrigerant system;

(d) discharging the liquid lubricant from the mechanical housing; and (e) delivering the liquid lubricant from the mechanical housing to a compressor sump within the mechanical refrigeration system.

2. The method of claim 1, wherein said delivering utilizes a pressure differential between the compressor sump and the mechanical housing to push the liquid lubricant from the mechanical housing to the compressor sump.

3. The method of claim 1, wherein said heating continues until a first predetermined temperature is reached.

4. The method of claim 3, which further includes maintaining the contaminated liquid refrigerant within a first predetermined temperature range to substantially separate the quantity of the contaminated liquid refrigerant into the components comprising refrigerant material vapor and liquid lubricant.

5. The method of claim 3, which further includes sensing the temperature of the contaminated liquid refrigerant within the mechanical housing.

6. The method of claim 1, wherein said flowing the contaminated liquid refrigerant is from an evaporator forming a portion of the mechanical refrigeration system, and wherein said flowing is driven by gravitational forces.

7. The method of claim 1, wherein said flowing the refrigerant material vapor is to an evaporator forming a portion of the mechanical refrigeration system, and wherein said flowing delivers the refrigerant material vapor to the evaporator above the liquid level within the evaporator.

8. The method of claim 1, wherein said flowing the contaminated liquid refrigerant is from an evaporator comprising a portion of the mechanical refrigeration system, and which further includes allowing the liquid level in the mechanical housing to reach equilibrium with the liquid level within the evaporator before said heating.

9. The method of claim 1, wherein said flowing the contaminated liquid refrigerant is from an evaporator comprising a portion of the mechanical refrigeration system, and which further includes selectively creating a pressure within the mechanical housing greater than the pressure within the evaporator, and said creating operative to control the flow of contaminated liquid refrigerant to the mechanical housing.

10. The method of claim 10, which further includes regulating the pressure differential between the mechanical housing and the evaporator, and upon the pressure differential satisfying a first condition said flowing the refrigerant material vapor is triggered.

11. The method of claim 10, wherein upon the pressure differential satisfying a second condition said flowing the refrigerant material vapor is stopped.

12. The method of claim 1, which further includes repeating the acts of (a)–(e).

13. The method of claim 1, wherein the mechanical refrigeration system includes a compressor, and wherein the acts (a)–(e) occur irrespective of whether the compressor is running.

14. The method of claim 1, which further includes delivering the liquid lubricant from the mechanical housing to a compressor sump within the mechanical refrigeration system, wherein said delivering utilizes a pressure differential between the compressor sump and the mechanical housing to push the liquid lubricant from the mechanical housing to the compressor sump;

which further includes maintaining the contaminated liquid refrigerant within a first predetermined temperature range to substantially separate the quantity of the contaminated liquid refrigerant into refrigerant material vapor and liquid lubricant;

wherein said flowing the contaminated liquid refrigerant is from an evaporator forming a portion of the mechanical refrigeration system, and wherein said flowing is driven by gravitational forces;

wherein said flowing the refrigerant material vapor is to an evaporator forming a portion of the mechanical refrigeration system, and wherein said flowing delivers the refrigerant material vapor to the evaporator above the liquid level within the evaporator;

which further includes creating a pressure differential between the mechanical housing and the evaporator, and wherein the pressure within the mechanical housing is greater than the pressure within the evaporator; and which further includes regulating the pressure differential between the mechanical housing and the evaporator, and upon the pressure differential satisfying a first condition said flowing the refrigerant material vapor is triggered.

15. The method of claim 1, wherein said discharging delivers the liquid lubricant to an auxiliary container for at least one cycle of acts (a)–(e), and wherein said discharging delivers the liquid lubricant to the compressor sump for a plurality of cycles of acts (a)–(e).

16. The method of claim 1, wherein said flowing the quantity of contaminated liquid refrigerant occurring for a second predetermined period of time;

wherein said heating continues until a second predetermined temperature is reached;

which further includes maintaining the contaminated liquid refrigerant within a first predetermined temperature range for a third predetermined period of time to substantially separate the quantity of the contaminated liquid refrigerant into the components comprising refrigerant material vapor and liquid lubricant; and wherein said discharging the liquid lubricant occurring for a fourth predetermined period of time.

17. The method of claim 16, wherein the second predetermined period of time is about thirty minutes;

wherein the second predetermined temperature is about 145° F.;

wherein the third predetermined period of time is about two and one-half hours; and wherein the fourth predetermined period of time is about six minutes.

18. A system comprising:

a mechanical refrigeration system including a compressor having a lubricant sump, a condenser and an evaporator including a vessel, said refrigeration system containing an amount of contaminated liquid refrigerant including at least refrigerant material and lubricant material; and a purge unit disposed in fluid communication with the mechanical refrigeration system, said purge unit comprising:

a mechanical housing having a first end and an opposite second end and an interior volume adapted to receive a quantity of the contaminated liquid refrigerant, said mechanical housing having a contaminated liquid refrigerant material inlet proximate said first end, a lubricant outlet proximate said first end and a gaseous material outlet proximate said second end;

a heater disposed in heat transfer relationship with said mechanical housing and operatively controlled to provide heat to the interior volume to vaporize the refrigerant material within the contaminated liquid refrigerant into a refrigerant vapor and substantially separate the refrigerant material from the lubricant;

wherein said contaminated liquid material inlet is coupled in fluid communication with said vessel, wherein said lubricant outlet is coupled in fluid communication with said lubricant sump, and further wherein said gaseous material outlet is coupled in fluid communication with said vessel; and wherein the flow of contaminated liquid material from said vessel to said liquid material inlet is by gravitational forces, and said heater is operable to vaporize the refrigerant material to the refrigerant vapor and create a pressure differential between said interior volume and said lubricant sump and said vessel, and wherein the pressure differential is utilized to selectively push the lubricant through said lubricant outlet and to said lubricant sump and further selectively push the refrigerant vapor through said gaseous material outlet and to said vessel.

19. The system of claim 18, which further includes a first flow control device at said contaminated liquid refrigerant material inlet and a second flow control device at said lubricant material outlet and a third flow control device at said gaseous material outlet, wherein said flow control devices are operative to control the fluid flow into and out of said mechanical housing.

20. The system of claim 19, which further includes a temperature sensor for sensing the temperature of the fluid within said mechanical housing, wherein said temperature sensor is located proximate said first end, said mechanical housing includes a first interior volume portion proximate said first end and said temperature sensor is operable to sense the temperature within said first interior volume portion.

21. The system of claim 20, wherein said first interior volume portion is filled with lubricant that is not discharged from the mechanical housing.

22. The system of claim 18, wherein said purge unit is located proximate said mechanical refrigeration system so that the liquid level with the mechanical housing is within a range of about one-half to two-thirds of said mechanical housing, and wherein said contaminated liquid refrigerant material inlet is coupled to a liquid refrigerant charging valve on said vessel.

23. The system of claim 18, wherein the pressure differential is maintained within a range of about 6 psi to about 9 psi.

24. The system of claim 18, which further includes a vapor filter for filtering the refrigerant vapor before discharge from said gaseous material outlet, and which further includes a lubricant filter for filtering the lubricant material discharged from said lubricant outlet.

25. The system of claim 24, wherein said vapor filter includes coupling means for quick coupling to said mechanical housing, wherein said coupling means operable to block the escape of refrigerant vapor from said mechanical housing when said filter is removed from said mechanical housing.

26. The system of claim 18, which does not include a pump for delivering the contaminated liquid refrigerant material to said mechanical housing.

27. A method for substantially removing a lubricant material from a contaminated liquid refrigerant within a mechanical refrigeration system, comprising:

(a) flowing a quantity of the contaminated liquid refrigerant by gravitational force from an evaporator within the mechanical refrigeration system into a mechanical housing of a purge unit;

(b) heating the contaminated liquid refrigerant within the mechanical housing to a first predetermined temperature appropriate for the substantial separation into components comprising refrigerant material vapor and liquid lubricant;

(c) sensing the temperature within the mechanical housing to determine whether the first predetermined temperature has been satisfied;

(d) maintaining the contaminated liquid refrigerant within a first predetermined temperature range for a first predetermined time and substantially separating the quantity of contaminated liquid refrigerant into refrigerant material vapor and liquid lubricant;

(e) flowing the refrigerant material vapor from the mechanical housing into the evaporator at a location above the liquid level of the evaporator;

(f) pushing the liquid lubricant from the mechanical housing with a pressure differential between the mechanical housing and the mechanical refrigeration system; and (g) repeating acts (a)–(f) for all of the contaminated liquid refrigerant within the mechanical refrigeration system.

28. The method of claim 27, which further includes creating a pressure within the mechanical housing greater than the pressure within the evaporator, and which further includes regulating the pressure differential between the mechanical housing and the evaporator, and upon the pressure differential satisfying a first condition said flowing the refrigerant vapor is triggered and upon the pressure differential satisfying a second condition said flowing the refrigerant vapor is stopped.

29. A refrigeration purge system, comprising:

a mechanical housing having a first end and an opposite second end and an interior volume adapted to receive a quantity of a contaminated liquid refrigerant, said mechanical housing having a contaminated liquid refrigerant material inlet proximate said first end, a lubricant outlet proximate said first end and a gaseous material outlet proximate said second end;

a heater disposed in heat transfer relationship with said mechanical housing and operatively controlled to provide heat to the interior volume to vaporize the refrigerant material within the contaminated liquid refrigerant into a refrigerant vapor and substantially separate the refrigerant material from the lubricant; and wherein said heater is operable to vaporize the refrigerant material to the refrigerant vapor and create a pressure differential between said interior volume and a lubricant sump within a refrigeration system, and wherein the pressure differential is selectively used to push the lubricant through said lubricant outlet and to the lubricant sump and further selectively push the refrigerant vapor through said gaseous material outlet.

30. The system of claim 29, which further includes a pressure switch exposed to the environment within said mechanical housing and the environment within a portion of the refrigeration system, wherein said pressure switch being operable to signal the release of refrigerant vapor through said gaseous material outlet.

31. The system of claim 29, which further includes a temperature sensing portion of said mechanical housing proximate said first end, said temperature sensing portion including a reservoir portion adapted to hold a quantity of lubricant below the discharge level of said lubricant outlet, and which further includes a temperature sensor extending into said reservoir.

32. The system of claim 29, which further includes a first flow control device at said contaminated liquid refrigerant material inlet and a second flow control device at said lubricant material outlet and a third flow control device at said gaseous material outlet, wherein said flow control devices are operative to control the fluid flow into and out of said mechanical housing.

33. The system of claim 32, wherein said first flow control device includes a ball check having a ball and a seat, the passage of contaminated liquid refrigerant through said ball check is controlled by a pressure differential between said interior volume and the pressure of the contaminated liquid refrigerant prior to said seat.

34. The system of claim 29, which further includes a vapor filter for filtering the refrigerant vapor before discharge from said gaseous material outlet, and which further includes a lubricant filter for filtering the lubricant material discharged from said lubricant outlet.

35. The system of claim 34, wherein said vapor filter includes coupling means for quick coupling to said mechanical housing, wherein said coupling means operable to block the escape of refrigerant vapor from said mechanical housing when said filter is removed from said mechanical housing.

* * * * *